United States Patent [19]

De Freitas

[11] 4,429,813

[45] Feb. 7, 1984

[54] MECHANICAL DEVICE TO TRANSFER LIQUIDS FROM CONTAINERS

[75] Inventor: Elias M. De Freitas, Porto Alegre, Brazil

[73] Assignee: Termolar S/A, Porto Alegre, Brazil

[21] Appl. No.: 339,547

[22] Filed: Jan. 15, 1982

[30] Foreign Application Priority Data

Jan. 23, 1981 [BR] Brazil ..... 8100430

[51] Int. Cl.[3] ..... B67D 5/42; B67D 5/50

[52] U.S. Cl. ..... 222/207; 222/214; 222/385; 417/472

[58] Field of Search ..... 417/472, 479, 480; 222/257, 211, 214, 320, 380, 382, 385

[56] References Cited

U.S. PATENT DOCUMENTS

| | | | |
|---|---|---|---|
| 332,108 | 12/1885 | Richards et al. | 222/385 X |
| 804,009 | 11/1905 | Howland | 222/385 X |
| 2,368,091 | 1/1945 | Andersen | 222/207 UX |
| 2,702,147 | 2/1955 | Brown | 222/385 X |
| 3,144,177 | 8/1964 | Cookson | 222/385 X |
| 3,409,184 | 11/1968 | Stengle, Jr. | 417/472 X |
| 4,320,859 | 3/1982 | Shy | 222/401 |

*Primary Examiner*—David A. Scherbel

*Attorney, Agent, or Firm*—Beveridge, DeGrandi & Kline

[57] ABSTRACT

A mechanical device is described consisting essentially of an upper body and a flexible bell shaped member, immersed in liquid and equipped with disc valve, placed in a housing on the lower part of the bell shaped member, that is fitted in a rigid reinforcing ring. This bell shaped member compressed by the activating flange of the transferring pipe, whenever the actuating button is pressed, makes the liquid flow out through the pipe up to the pouring spout. When turning the outer cover of the upper body, the system is locked, sealing the pouring spout and may be unlocked when ready to use.

15 Claims, 7 Drawing Figures

MECHANICAL DEVICE TO TRANSFER LIQUIDS FROM CONTAINERS

The present invention relates to a mechanical device consisting essentially of an immersed pump adaptable in containers in order to transfer liquids contained therein without the need of inclining them by mechanical manual action.

Devices with the same purpose have been used for some time in thermos jugs (vacuum flasks) of Japanese, Chinese (Taiwan) and American production. In all these jugs the same basic working principle is used, consisting of the introduction of a certain volume of air into a sealed container for containing liquids which, by the increase of the internal pressure, causes the outflow of a corresponding volume of this liquid, through a pipe inserted therein and communicating with the outside.

These devices consist essentially of flexible—body pumps which can be of the types "bellows" or "invagination" (with cylindrical stretchable walls that distort themselves interpenetrating one to another).

As examples of the "bellows" type, the following models are noted: Thermos' 2647 BARTENDER and 7771/P "JETJUG", Japanese ZOJIRUSSHI VACCUM BOTTLE CO. LTP and AIR-POT-Hsin MAIN-TAIPEI from Taiwan. As examples of the second type, the following models are noted: Alladin's PUMP-A-DRINK JUG No. 575 and No. 585, as well as the SERVE-A-JATO, made in Brazil, where there is also a practically identical version, Invicta's PRESSO-SERV and finally Thermos' model—2645 TOUCH-TOP.

In these various models or devices that permit the pumping of doses of liquids by air compression, there is a series of auxiliary mechanical elements such as valves etc., to improve their functioning. In some cases such as Alladin's models no. 575, no. 585, Serve-a-jato and Invicta's PRESSO-SERV, the admission valve is replaced by the action of a finger which closes the air inlet in the moment of pressing the pump.

Although all the pumps mentioned are rather efficient, they present two great disadvantages, as follows:

1. For practical reasons, because the air volume injected is relatively small. the volume of the containers cannot exceed certain limits, otherwise part of its contents could not be pumped.

This will happen in large containers when the relation between the air volume and the volume of the liquid contained inside the container is such that, each individual pumping does not cause sufficient pressure increase to exceed the manometrical pressure related to the height of the outflow pipe. In order to obtain enough pressure, it would be necessary to pump several times, what would require valves that prevented the air return, making necessary a way to interrupt voluntarily the flow of the liquid when the desired quantity is obtained, otherwise the liquid would go on flowing out of control.

This would unduly complicate a mechanism whose main advantage resides in the basic simplicity of use—one pumping—one dose of liquid.

2. The containers must be tall and of small cross-section, because for a given volume, the evaporation surface must be small to avoid self-pumping.

The self-pumping effect has forced Alladin to warn against the use of hot liquids in its model PUMP-A-DRINK GALLON JUG —ref 585.

Another problem with the above described containers is that the communication of the liquid with the outside remains constantly open through the outflow pipe.

This is extremely inconvenient in dusty environments or where there are insects that, attracted by sweet drinks, will invade the spout and the outflow pipe.

There are some models that in order to avoid the mentioned inconvenience, have small rubber stoppers for closing the pouring spout. The problem with this solution is that if the stopper is left in the spout when pumping, it would cause a real explosion of hot liquid.

Only Thermos' model 2645 TOUCH-TOP was designed with a "drawer spout" which simultaneously closes the outflow orifice and locks the pump when pushed in. When the "drawer spout" is pulled out, it unlocks the pump and allows serving.

Several models from Japan and Taiwan are provided with some kind of lock to prevent the accidental pumping.

Another inconvenience of the mentioned pumps is the need of a good sealing between the lid and the containers, because if there is an escape of pumped air, the liquid will not flow out.

From what was known heretofore, the aim of this invention is the development of a new pumping device in which the disadvantages mentioned above would be avoided.

The device of this invention features a pump based on a principle totally different from the previously mentioned one, since it does not depend on the compression of air into containers and therefore does not require airtight sealing.

It is a feature of this invention that the device is formed by an upper body and by a pump, which is located in the bottom of the container, both parts being linked by a vertical transference pipe.

The upper body can, through its connection ring, be fixed in a container by a system of screw threads by a "bayonet" joint or simply fitted in under pressure.

Just above the connection ring, there is an external rotating cover, guided by the lower edge border, in the reentrance formed between the prominent edge and a "bearing-cover" and a protuberance of the connection ring attached to it permanently. The rotating cover is provided with a side protuberant portion forming a pouring spout. This spout, together with the cover, can easily be turned to the rear of the container where it is closed by a protuberance existing for this purpose, the pump being simultaneously locked. When the spout is turned to the front up to the stop which marks the "serve" position and the activating button is pressed, the latter, through the movable coupling of the transference pipe and the corresponding activating flange, compresses and distorts a flexible bell shaped cover attached to it, which is immersed in the liquid. The liquid contained in the bell shaped cover cannot flow out by the lower opening obstructed by a disc valve which is forced against the ring-like border of the lower edge of the valve housing in the bell shaped cover by the pressure of the liquid.

For this reason, the liquid, being incompressible, is expelled from the bell shaped cover through the transference pipe, the movable coupling and the flexible pipe, flowing out through the pouring spout.

In the above mentioned device the outflow of the liquid occurs freely, and its flux depends exclusively on the manner in which the activating button is pressed, therefore the flux does not depend on the level of the liquid; even in a large volume container it being always possible to pump all of the contents.

The pipe which connects the movable coupling to the pouring spout is flexible in order not to transmit the up and down movement from the movable coupling to the pouring spout which remains fixed. This disposition also allows a minimum opening of all the elements of the pump. The movements of the movable coupling and of the transference pipe are guided by a cylinder that moves up and down the "bearing-cover" and is called the "guide-pipe" of the cover.

When the manual pressure on the activating button ceases, it goes up together with the movable coupling, due to the reaction of the spring, compressed in the pumping action.

This in turn forces the transference pipe and the corresponding activating flange to move up, letting go the flexible bell shaped cover which returns to its original shape, aspirating the liquid through the wide ring-like opening of its lower part, where there is the disc-valve, which is lifted by the difference of pressure between its outer and inner faces.

The disc-valve has its upward movement limited by the protuberances located in the internal part of the upper edge of its housing in the flexible bell shaped member.

Therefore, when the pressure on the activating button ceases, the flexible bell shaped member is immediately filled with liquid, making the system ready to be activated again. In the lower part of the "guide-pipe" of the "bearing-cover", there are small orifices that permit in necessary air for the substitution of the volume of liquid already pumped from the container.

One extremely important characteristic of this pump is to be totally immune to problems of air escape in the container, for its functioning does not depend on the increase of the inner pressure, but only on the compression of the charge of liquid contained in the flexible bell shaped member.

Another totally original and important aspect is the closing of the pouring spout coordinated to the locking of the pump, both obtained by a simple turn of the pouring spout to a position opposite to the "serve" position. Also another advantage of the new system is the elimination of valves in the upper body, and the elimination of holes in the pump lid which would have to be closed with fingers in the act of pumping. This hole, in the models that require it is an additional entrance point for impurities in the pump.

The use of the pump, becomes consequently, extremely easy for the user: pouring spout to the front-serve; pouring spout to the rear-lock and close.

When the pouring spout is turned to the rear, in the "lock" position the outflow orifice is closed by a system of elastic fitting in the hemispherical hump of the protuberance existing in the rear on the container.

This is the way to prevent the pump, when transported or out of use, from having the pouring spout contaminated by impurities or insects attracted by the sweet content of the container.

This solution also has the advantage of protecting the pouring spout, preventing it from protruding during transportation, and from being turned accidentially, due to the elastic fitting and to the disposition of the handle of the container when lifted.

To this is added the facility of dissassembling and the extreme ease by which all the components in touch with the liquid may be reached, making them easy to be completely cleaned.

The objectives, advantages and innovations of this invention become evident in the following description of a preferred mode of the invention, when considered in connection with the drawings in which.

Figure 1:
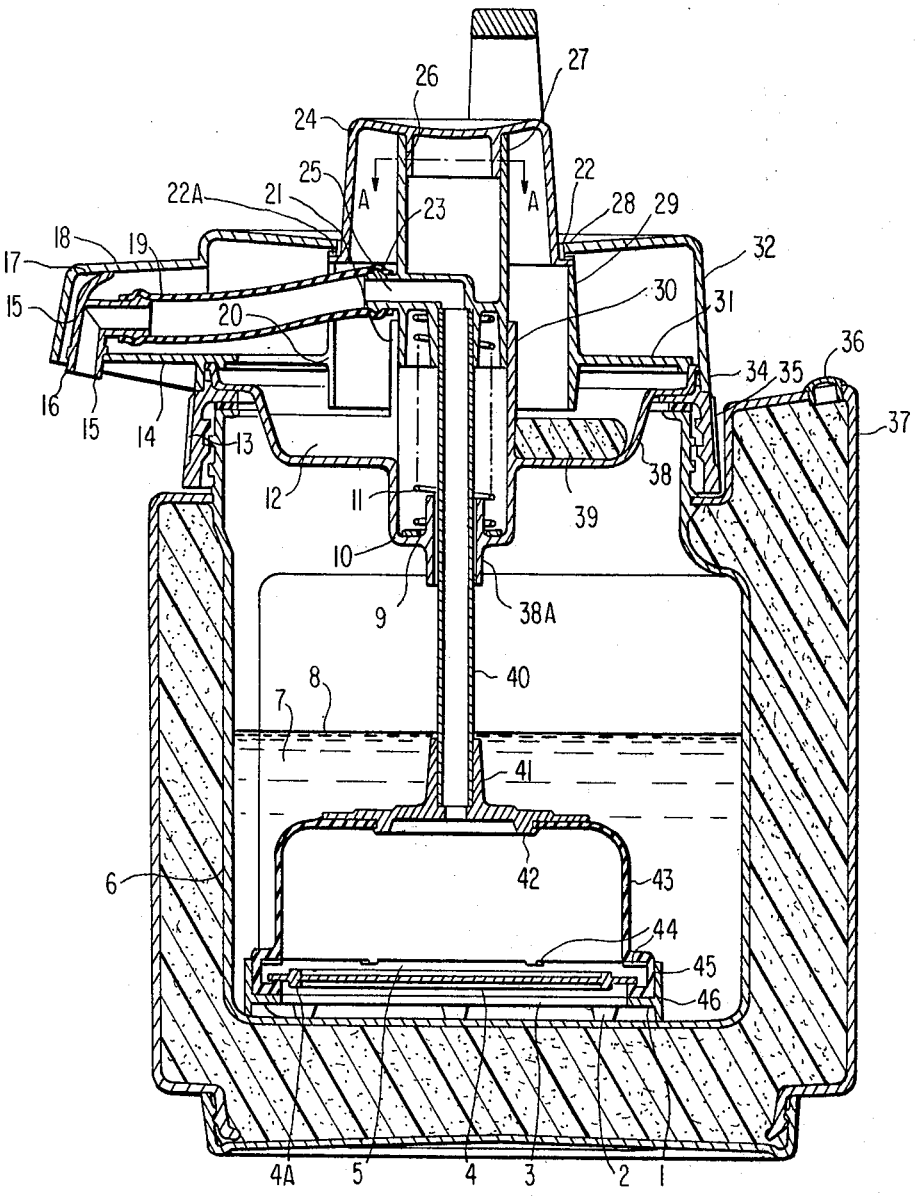
FIG. 1 is a cross-sectional view of the device in resting position.
Figure 1A:
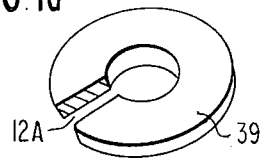
FIG. 1*a* is an isometric view of the thermal insulation plate and FIG. 1*b* is a view taken through section AA.
Figure 1B:
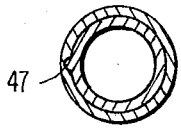
Figure 3:
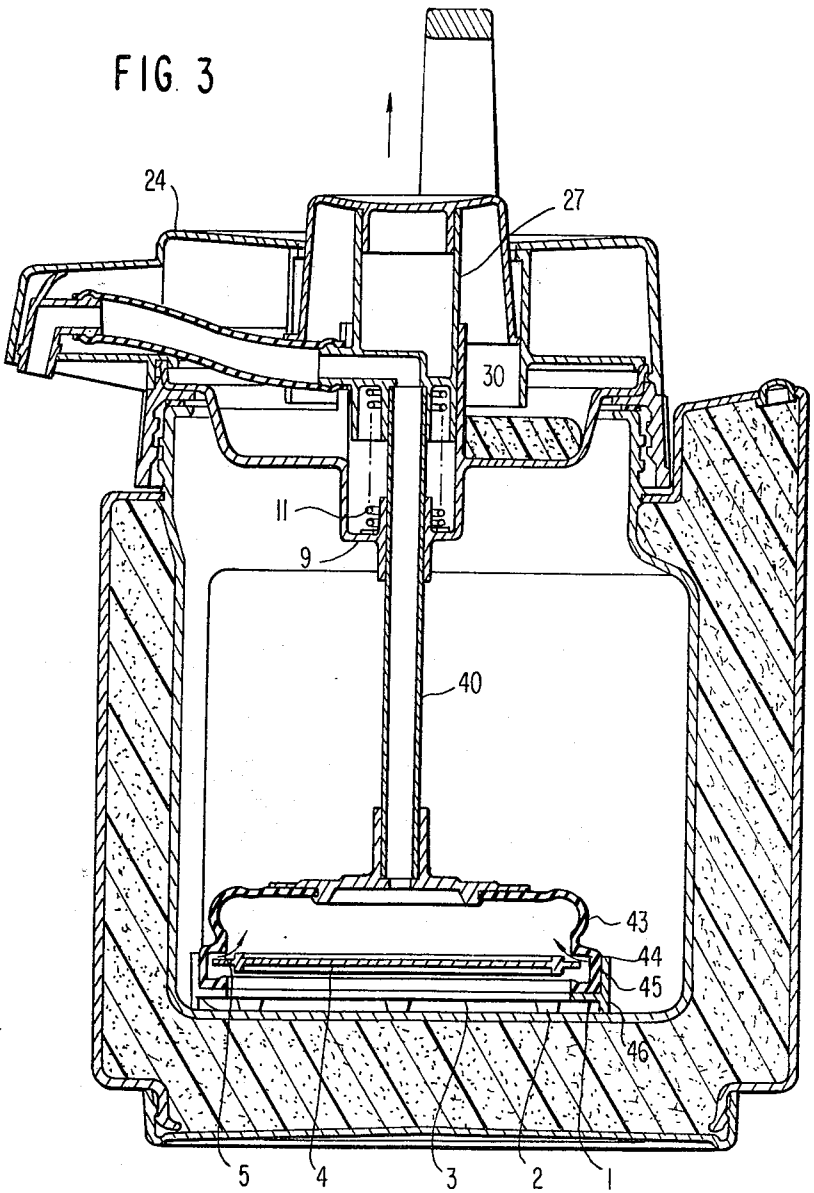
FIG. 3 is a cross-sectional view of the device when the upward movement begins.
Figure 2:
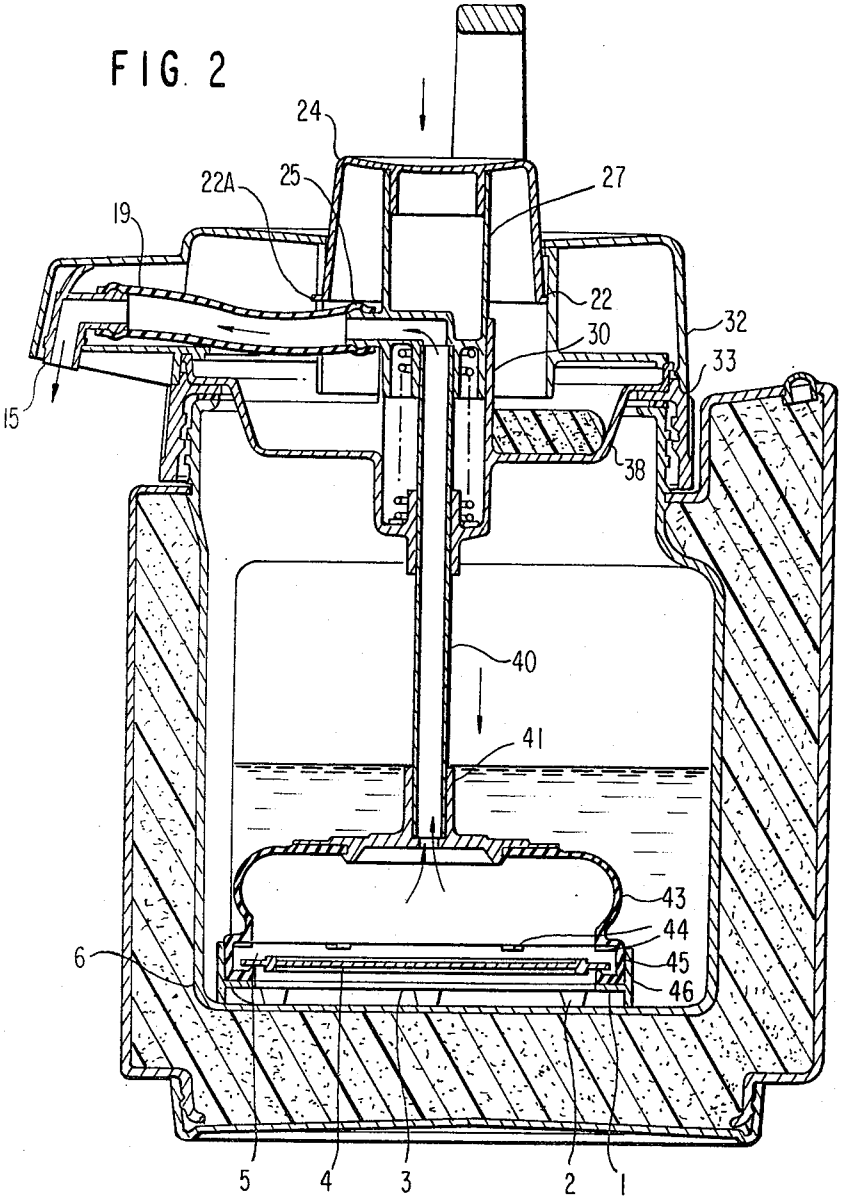
FIG. 2 is a cross-sectional view of the device in pump activating position.
Figure 5:
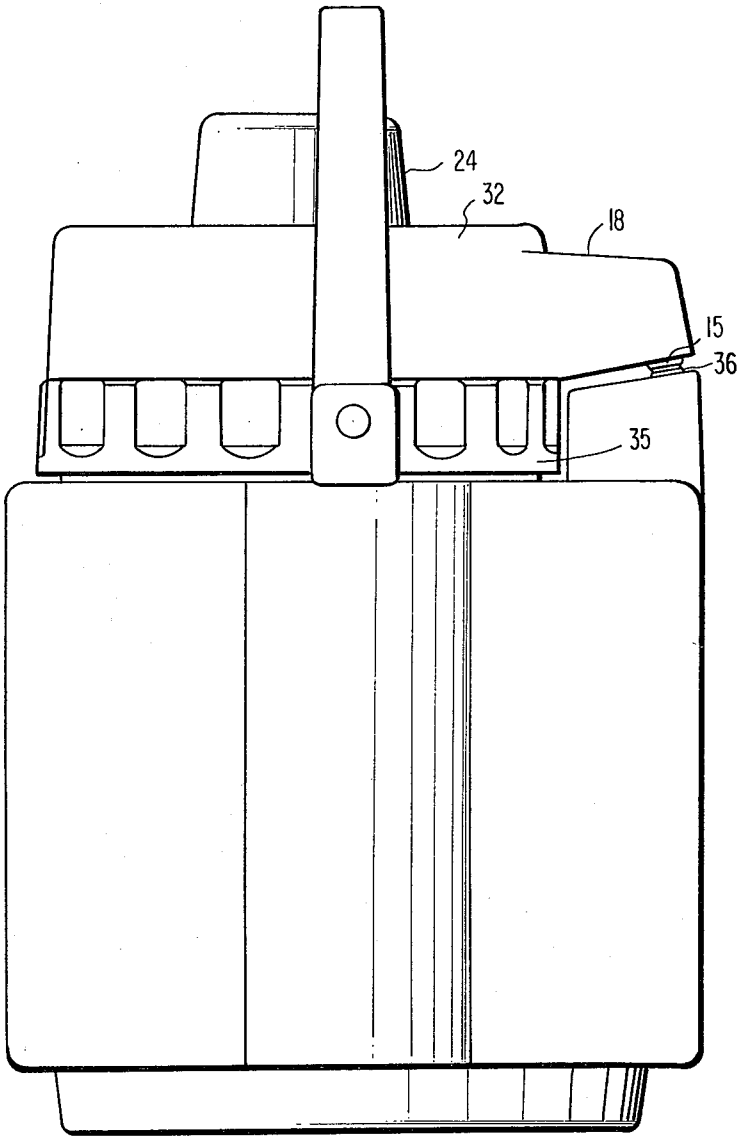
FIG. 5 is a side view of the set with the pump in "lock" position.
Figure 4:
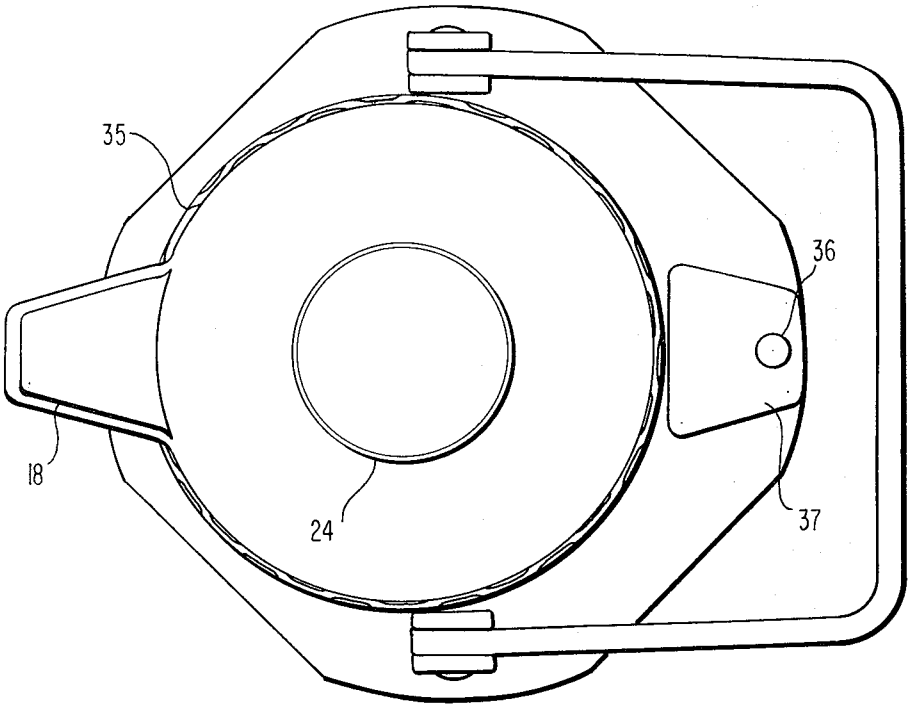
FIG. 4 is a top view of the device.

The pump consists essentially of a flexible bell shaped member (43), a disc-valve (4) provided with reinforcements (4A), a transference pipe (40), a movable couping (27), a flexible pipe (19), a pouring spout (15) and an actuating button (24). There is also a guide coupling (29) of the button, an external rotating cover (32) with a beak-like side protuberance (18), a return spring (11), a sliding washer (10), a threaded connection ring (35) and the corresponding sealing ring (13).

It also has an activating flange (41) inserted in the bell shaped member (43), attached to it by the panel or border (42) and a reinforcement ring (1) set in the lower edge of the bell shaped member. To explain the functioning of the pump, it is illustrated in relation to a container (6).

In the flange (22) of its lower edge, the actuating button (24) has a projection (22A) which fits in the vertical groove (20) of the guide coupling 29 of the botton. The groove (20) of the guide coupling (29) can also allow the passage of the flexible pipe (19). The cylindrical part of the piece (29) is provided, in the lower third of its height, with a circular disc-like plate (31) which has an extension (14) with an orifice (16) where the pouring spout (15) is adapted. The guide coupling (29) also has a re-entrant edge (28) in its upper part, which limits the upward movement of the actuating button (24) through its flange (22). The actuating button (24) is adapted to the movable coupling (27) through the casing or cylindrical projection (26) both becoming unitary in rotation movements through the fitting (47). The guide pipe (30) of the bearing cover (38) has a groove (21) which allows the free downward displacement of the tip (23) which attaches the flexible pipe (19) to the movable coupling (27), the bearing-cover (38) with its guide-pipe (30) is linked, by welding or any other method, to the threaded connection ring (35) thus forming the lowering or ring-like groove (33) where the rim (34) of the external rotating cover is housed.

In the bottom of the bearing-cover (38) there are two vertical partitions (12) that put into place a thermal insulation plate (39) through its groove (12A). In the bottom of the guide-pipe (30) there are small holes (9) that equalize the internal and the atmospheric pressure.

When the external cover (32) is turned it drags the extention (14) of the circular plate (31) of the guide coupling 29 of the botton. and together the pouring spout (15) with the flexible pipe (19), still through the actuating button (24), clamped in the groove (20) makes the movable coupling (27) rotate, so that the tip (23) is not anymore aligned with the groove (21) of the guide

(30) of the bearing cover (38) which, remaining stationary, prevents the downward movement of the set. This set, formed by: actuating button (24) movable coupling (27), transference pipe (40) and corresponding activating flange, will not be able then to press the flexible bell shaped member (43) and the pump stays locked. Turning the pouring spout 180° to the front of the container so that the tip (23) coincides with the groove (21) of the guide (30), the pump is unlocked and ready to work.

The pump working system is described as follows:

The liquid (7), being in a level (8) and contained in the container (6), fills the flexible bell shaped member (43) and the transference pipe (40) to the level (8) by the communicating vessels principle.

Pressing the actuating button (24), the movable coupling (27) slides downward guided by the central pipe (30) of the bearing cover (38). When the movable coupling (27) goes down, it will, through the transference pipe (40) and the corresponding activating flange (41) compress the flexible bell shaped member (43) distorting it against the reinforcement ring (1) which is supported by the prominences (2) in the bottom of the recipient (6).

With the distorting of the bell shaped member, the pressure of the liquid in it increases, forcing the disc valve (4) to rest against the rim (46) of the lower edge of its housing, making the liquid flow out through the transference pipe (40) passing through the "L" pipe (25) of the movable coupling (27) and through the flexible pipe (19) finally flowing out through the pouring spout (15). Releasing the actuating button (24), the return spring (11) causes, through the movable coupling (27), the return of the button (24) and of the transference pipe (40) to the initial position, allowing the bell shaped member to return to its original shape.

In this process, the liquid enters the bell shaped member through the lower opening (3) of the reinforcement ring (1), lifting the disc-valve (4), passing through the space between the latter and the side walls of its housing (45) in the flexible bell shaped member (43). The disc-valve (4) while going up, rests against the prominences (44) of the upper edge of its housing (45) in the flexible bell shaped member (43). These prominences produce ring-like fissures or windows (5) that allow the inflow of the liquid in the flexible bell shaped member (43) as shown by the flux indicating arrow.

With this, the flexible bell shaped member (43) is filled again, making the set ready to a new pumping.

The small orifices (9) allow the inlet of the external air necessary to replace the volume of the pumped liquid.

On the other hand, the position of these orifices in the bottom of the guide pipe (30), prevents the leaking of the liquid, even with sudden movements of the container. Outside the pump, there is a outside container (37), provided with a hemispherical hump (36), which closes the orifice of the pouring spout (15) when this is turned to the rear in order to lock the pump. To achieve this sealing, the spout (15) must be fitted into the hemispherical hump (36) flexing in slightly and then being elastically pressed against it. For this purpose, the spout (15) is provided, in its rear, with a flexible element (17) or a spring resting against the inner face of the rotating cover (32) spout protector (18). In this way, the spout is continuously pressed downward, and this movement is limited by the resting of the corresponding flange against the orifice edge (16) of the trapezoidal projection (14) of the plate (31). Another way of obtaining the same effect, is fitting the spout protector (18) in the orifice (16) so that it adjusts to the trapezoidal projection (14) which, in this case, would be flexible.

Due to the flexibility of the shaft (17), the pouring spout (15) can move upwardly, flexing sufficiently to fit, under pressure, into the hemispherical hump (36). The pouring spout is then perfectly sealed and a small effort allows its disengaging and its rotation to the pouring position.

It should be understood that the parts described here were intended only to serve as examples; their shapes, materials, and dimensions can be changed without deviating from the basic concept of the present invention. This is partly determined by the shape of the thermal container to be used. Variations and modifications of the foregoing as will be apparent to those skilled in the art are intended to be encompassed by the claims appended hereto.

I claim:

1. A mechanical device to transfer liquids from containers which, when fitted into a container, does not require its inclination, and does not depend on its air tightness and volume, comprising a pump including a flexible bell shaped member (43), with an upper orifice, and a widened ring-like area in its lower extremity, forming a housing (45) where a rigid veined disc is located forming a disc-valve (4), said housing being provided, in its upper internal edge, with small prominences (44) and the lower edge, which limits the opening of the mouth of the bell shaped member, and ends in a small inner vertical projection forming a continuous rim (46); a liquids transference pipe (40) connected to the upper orifice of the bell shaped member, and when a vertical manual compression effort is made, the bell shaped member is deformed, compressing the liquid inside it, thereby pressing the disc-valve (4) against the continuous rim (46) of the housing (45), thereby sealing of the mouth of the bell shaped member and forcing the liquid to flow out through the transference pipe (40); and the prominences (44) of the housing limit the upward movement of the disc-valve, leaving an empty space for the inflow of the liquid in the bell shaped member (43) when it returns to its original shape.

2. The mechanical device to transfer liquids from containers according to claim 1, wherein coupling between the bell shaped member and the vertical transference pipe (40) is made by means of an activating flange (41), with a disc shape, having in its upper face a pipe-like prolongation, into which is tightly introduced the vertical transference pipe (40), and the lower face of which rests and is fixed by a rim (42) to the upper part of the bell shaped member.

3. A vacuum flask or foam insulated container equipped with the pump device of claim 2.

4. The mechanical device to transfer liquids from containers according to claim 1, wherein the bell shaped member is externally surrounded, at its widened ring-like region, by a cylindrical reinforcement ring (1), which has small prominences (2) in its lower part, forming feet, which permit the pump to rest in the bottom of the container, leaving gaps for the liquid inflow; said cylindrical ring having a planar lower edge, which gives a uniform support to the mouth of flexible bell shaped member (43); the reinforcement ring (1), when removed, allows the withdrawing of the disc valve (4), due to the elasticity of the bell shaped member, thus permitting the easy cleaning of the pump.

5. The mechanical device to transfer liquids from containers according to claim 1, which further includes an upper body, to which is attached to said pump, through the upper extremity of the vertical transference and activation pipe (40), said body having a connection ring (35) which allows the fixation of the pump and upper body set to a container (6); which is made through a releasible fitting, whose elements in the container and in the ring maintain a correspondence that always ensures the same relative position of the parts and whose sealing is done by a sealing ring (13).

6. The mechanical device to transfer liquids from containers according to claim 5, wherein said upper body, has fixed permanently to the connection ring (35), a bearing cover (38) whose plane bottom is crossed centrally by a vertical cylindrical pipe (30) which serves as a guide for the up and down movements of the movable parts of the pump, said pipe having in its lower extremity, a diameter reduction (38A), through which passes the transference and activating vertical pipe (40), said cylindrical pipe (30) having in the part above the surface of the bottom of the bearing cover a vertical groove (21) which permits and guides the upward and downward movements of the movable elements of said set which further includes an activator button (24) and lodges a helicoidal spring (11) which causes the return of the actuating button (24) and other movable parts related to it, back to the initial position, said spring (11) being supported through a ring (10), on the step formed by the reduction (38A) of the diameter of the cylindrical pipe (30) there being at least one orifice (9) in order to equalize the container internal pressure with atmospheric pressure, said bearing cover (38) having two vertical partitions (12) housing on its flat bottom an insulating plate (39) in the shape of a disc opened by a slot (12A) for positioning it in relation to the bearing cover through said two vertical partitions (12).

7. The mechanical device to transfer liquids from containers in accordance with claim 6, wherein said upper body including said set of movable operation elements including said actuating button (24) and a cylindrical tube forming a movable coupling (27) centered in relation to the bearing cover (38), said cylindrical tube being equipped with, in its inner part, a horizontal wall which divides it internally into two parts, upper and lower and an "L"—shaped pipe (25) placed directly above the dividing wall, its horizontal branch forming a tip (23) which projects itself beyond the cylinder wall, at such a point that when cylindrical pipe of the movable coupling (27) is fitted to the actuating button (24), the tip (23) is located right below the lower edge of the button (24); the vertical branch of the "L"—shaped pipe (25) projecting downwardly through the dividing wall concentrically with the cylinder and having an inner diameter equal to the outer diameter of the transferring vertical pipe (40) into which it is fitted, the lower part of the dividing wall and the cylinder itself providing a housing for the upper helicoidal spring (11).

8. The mechanical device to transfer liquids from containers in accordance with claim 7, wherein the actuating button (24) comprises a body in the shape of an upside down cup, finished on its lower end by a prominent continuous edge, forming a flange (22), and equipped with a small tooth-like projection (22A); said button presenting in its inner part, a projection or cylindrical skirt (26) into which the upper end part of the movable coupling (27) of the cylindrical tube is fitted.

9. The mechanical device to transfer liquids from containers in accordance with claim 8, wherein said coupling (27) has a vertical slot (47) and said cylindrical skirt (26) has a vertical rib fitted to the corresponding slot (47) of the movable coupling pipe (27), connecting both parts in relation to the rotating movements, whereby tip (23) of the "L"-shaped pipe (25) of the coupling remains always aligned with the small tooth-like projection (22A) of the actuating button (24) edge.

10. The mechanical device to transfer liquids from containers according to claim 9, wherein said set of movable elements are put into place through the use of a guide-coupling part (29), formed by a circular plate (31) with lower rim to which the bearing cover (38) is adapted, and which can turn freely in relation to it, said circular plate (31) having a trapezoidal projection (14) defining a spout, said plate (31) having a cylindrical projection on its central part, which extends itself up and down from the plate, and a vertical slot (20), extending up and down from the circular plate (31), and having on its upper end a reentring edge (28) which, being continuous, limits on the upper part said vertical slot (20), forming a stroke-ending arrestment for the upward movement of the actuating button (24) through the lower flange (22), said circular plate (31) having, aligned with the slot (20) of its central cylindrical pipe, a slot in the direction of its trapezoidal projection, allowing the downward movement of the activating button, when it is aligned with the slot (21) of the cylinder (30) of the bearing cover (38), and permitting the downward movement of the actuating button (24), the trapezoidal projection (14) of the plate (31) having an orifice (16), into which is introduced the vertical branch of the "L"-shaped pouring spout (15), being its horizontal branch facing the center of the circular plte (31), said horizontal branch of said spout is connected, by means of a flexible pipe (19) to the tip (23) of the "L"-shaped pipe (25) of the movable coupling cylinder (27), passing though the slot (20) of the cylinder of the guide-coupling piece (29).

11. The mechanical device to transfer liquids from containers according to claim 10, wherein the guide coupling part (29) is fitted to the bearing cover (38), so as to enable a relative turn between them limited to 180°, as permitted by a stop on the lower face of the circular plate (31) of the guide-coupling part (29) and two diametrically opposed stop ribs on the bearing cover (38), said 180° turn occurs between the position of liberation of up and down movement of the actuating button (24) and the locking position, the locking being achieved turning the guide-coupling part (29) when the tip (23) of the "L"-shaped pipe of the movable coupling (27) is out of line in relation to the vertical slot (21) of the cylinder (30) of the bearing cover (38).

12. The mechanical device to transfer liquids from containers according to claim 11, wherein the upper body is equipped with a turning cover (32) cylindrical in shape, with a spout cover (18) in the shape of a hollow truncated pyramid covering the trapezoidal projection (14) of the guide-coupling part (29), said cover open on its lower part, is defined at the top by a level surface which has an orifice allowing the passage of the actuating button (24), said surface serving as an upper arrestment of the guide-coupling part (29), whose lower arrestment is the bearing cover (38), first through the reentring upper edge (28) of the central cylinder and then the circular plate (31) of the guide-coupling part, said rotating cover (32) is in turn fitted by its rim (34) to a ring-like groove (33), formed by the upper edge of the bearing cover (38) and by the threaded connection (35) so as to allow the cover to turn.

13. The mechanical device to transfer liquids from containers according to claim 12, wherein when the trapezoidal projection (14) of the guide-coupling part (20) fitted internally in the spout cover (18) of the turning cover (32), is rotated, its rotating movements are transmitted to the guide-coupling, thus alternately freeing or locking the actuating button (24).

14. The mechanical device to transfer liquids from containers according to claim 13, which further comprises an outside receptable (37) having a hemispherical hump (36) wherein the cover (32), when turned, rotates the guide-coupling part (29) and the pouring spout (15), so that the orifice (16) is closed by said hemispherical hump (36), when the mechanism is locked, the engagement of the spout to the hemispherical hump thereby achieving effective sealing against insects and dust, said engagement being obtained by the flexing of the trapezoidal projection (14) of the guide-coupling part (29).

15. A vacuum flask or foam insulated container equipped with the pump device of claim 1.

* * * * *